US006945283B2

(12) United States Patent
Markward et al.

(10) Patent No.: US 6,945,283 B2
(45) Date of Patent: Sep. 20, 2005

(54) MEASURING APPARATUS FOR MEASURING THE CLOTH TENSION IN A WEAVING MACHINE AND A WEAVING MACHINE WITH A MEASURING APPARATUS OF THIS KIND

(75) Inventors: Dietmar Markward, Rüti (CH); Erich Gasser, Wiesendangen (CH)

(73) Assignee: Sulzer Textil AG, Rueti (CH)

( * ) Notice: Subject to any disclaimer, the term of this patent is extended or adjusted under 35 U.S.C. 154(b) by 198 days.

(21) Appl. No.: 10/280,479

(22) Filed: Oct. 24, 2002

(65) Prior Publication Data

US 2003/0094210 A1 May 22, 2003

(30) Foreign Application Priority Data

Nov. 16, 2001 (EP) ..... 01811105

(51) Int. Cl.[7] ..... D03D 41/00
(52) U.S. Cl. ..... 139/194
(58) Field of Search ..... 139/311, 103, 139/110, 293; 73/862.194

(56) References Cited

U.S. PATENT DOCUMENTS 4,445,545 A * 5/1984 Juillard et al. ..... 139/311
5,025,837 A 6/1991 Gielen
5,305,802 A 4/1994 Fehrenbach
5,628,346 A * 5/1997 Corain et al. ..... 139/110
5,649,569 A 7/1997 De Jager et al.
6,230,754 B1 * 5/2001 Kakuda ..... 139/25
6,311,737 B2 * 11/2001 Wahhoud et al. ..... 139/50
6,450,212 B1 * 9/2002 Quick ..... 139/311

FOREIGN PATENT DOCUMENTS

JP 02307938 A 12/1990

* cited by examiner

*Primary Examiner*—John Calvert
*Assistant Examiner*—Andrew W. Sutton
(74) *Attorney, Agent, or Firm*—Townsend and Townsend and Crew LLP

(57) ABSTRACT

A measuring apparatus for the measurement of the cloth tension in weaving machines comprises a probe element and a guide part to which the probe element is connected in order to guide the probe element. The measuring apparatus furthermore comprises a holder to which the guide part is secured and a sensor element which is in contact with the probe element in such a manner that a force which acts on the probe element causes a corresponding change in the sensor element. In this the guide part is attached at one side to the holder, the probe element is spaced from the attachment of the guide part, and the measuring apparatus is executed as a module.

15 Claims, 3 Drawing Sheets

Figure 1:
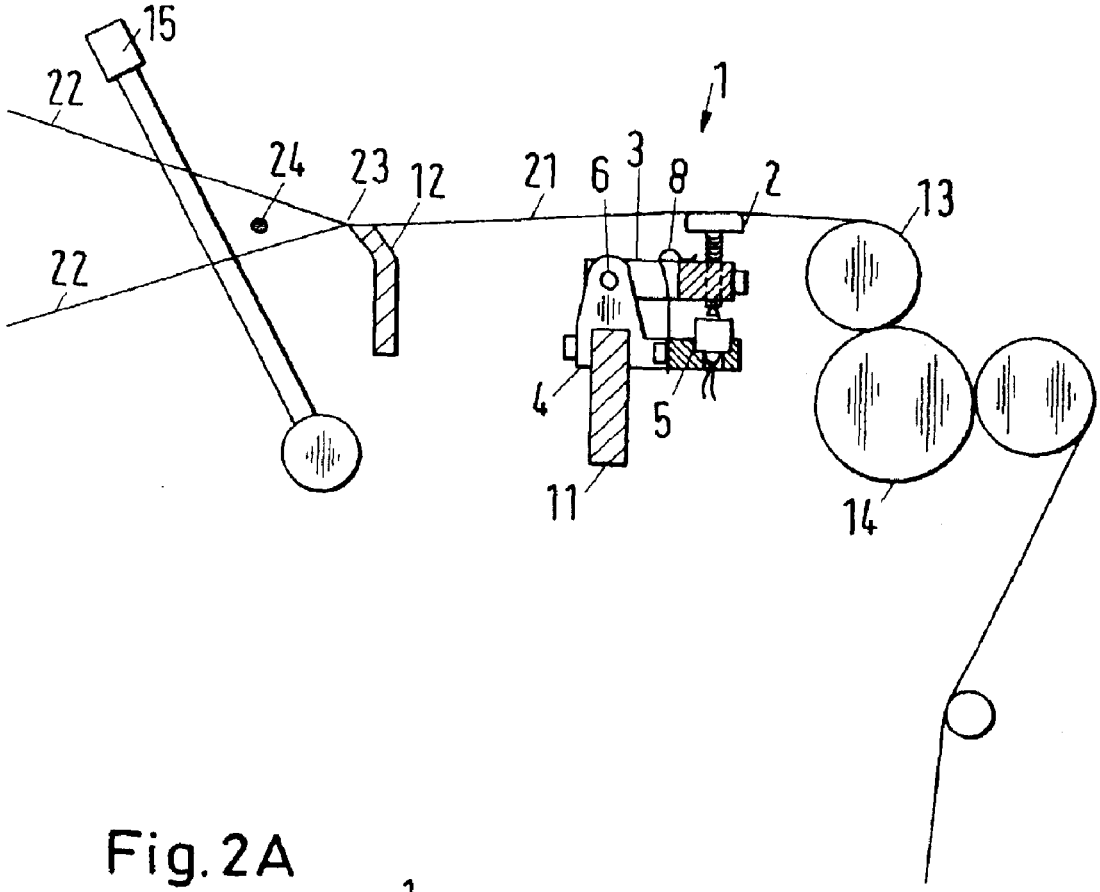

MEASURING APPARATUS FOR MEASURING THE CLOTH TENSION IN A WEAVING MACHINE AND A WEAVING MACHINE WITH A MEASURING APPARATUS OF THIS KIND

BACKGROUND OF THE INVENTION

The invention relates to a measuring apparatus for measuring the cloth tension in a weaving machine and to a weaving machine with at least one measuring apparatus of this kind. Furthermore, the invention relates to a weaving machine with two warp beams, which is equipped with at least one measuring apparatus each for the measurement of the cloth tension for each warp beam.

In weaving machines the warp let-off must be regulated in such a manner that the warp tension is held constant independently of the diameter of the warp beam. For this purpose the warp tension was previously measured directly. The warp tension can however also be determined indirectly from measurements of the cloth tension. The specifications DE 39 05 881 C2 and EP 0 385 061 B2 describe "warp tension measurement devices" in which the cloth tension is measured by means of a measuring apparatus which is inserted into the breast beam. The Japanese laying-open print JP 2-293444 discloses a measuring apparatus for the measurement of the cloth tension in or at the breast beam for the precise determination of the warp thread tension. In a first embodiment a load cell is let into the breast beam. In a second embodiment the breast beam is rotatably journalled and the contact pressure force on the breast beam is transmitted to one or more load cells which are in connection with the breast beam. The Japanese laying-open print JP 2-307938 describes a measuring apparatus which is secured to the breast beam and measures the cloth tension between the cloth edge and the breast beam.

All of the above-mentioned measuring apparatuses for measuring the cloth tension from the prior art are firmly connected to the breast beam. This is considered disadvantageous since these solutions are not very flexible. Since the cloth tension is not constant over the width of the cloth (it is the greatest in the middle and decreases significantly in the direction towards the weaving edges), it is necessary in certain cases, with different cloth widths, to adapt the position of the measuring apparatus for measuring the cloth tension in the width, i.e. transversely to the direction of travel of the cloth. This holds in particular for weaving machines in which the draw in is asymmetric, i.e. is carried out with one-sided width variation of the warp draw in width and/or of the cloth width respectively. A simple adaptation of the measurement position transversely to the direction of travel of the cloth is however not possible with the mentioned measuring apparatuses from the prior art. In this regard, double beam weaving machines present a special problem. Not only must the warp tension for each warp beam be measured individually and held constant, but the warp tensions of the two warp beams must also be of exactly equal magnitude.

SUMMARY OF THE INVENTION

An object of the invention is to provide a simple and precise measuring apparatus for the measurement of the cloth tension in a weaving machine which avoids the disadvantages of the prior art, and which is also suitable in particular for the measurement of the cloth tension in double beam weaving machines. A further object of the invention is to provide a weaving machine with at least one measuring apparatus of this kind.

The measuring apparatus in accordance with the invention for the measurement of the cloth tension in weaving machines includes a probe element, for example an elongate probe tube or a probe strip, in order to pick up the pressure exerted on a cloth and a force vector resulting therefrom and also includes a guide part, for example a lever or a leaf spring, to which the probe element is connected in order to guide the probe element in the direction of the force vector. The measuring apparatus of the invention furthermore comprises a holder to which the guide part is secured and a sensor element which is operatively connected to the probe element so that the force vector which acts on the probe element causes a corresponding change in the sensor element, for example a change in the resistance or in the output current. In the measuring apparatus in accordance with the invention the guide part is secured at one side to the holder, the probe element is arranged with a spacing from the attachment of the guide part, and the measuring apparatus is executed as a module or independent constructional unit. This means that in the measuring apparatus in accordance with the invention the probe element, the guide part, the holder and the sensor element are designed and/or used exclusively for the requirements of the measuring apparatus.

The holder of the measuring apparatus in accordance with the invention is preferably displaceably mountable on a carrier or on a carrier section. The probe element of the measuring apparatus in accordance with the invention is preferably guided substantially perpendicularly to a cloth surface which is to be probed. The guide part of the measuring apparatus in accordance with the invention is preferably rotatably and/or flexibly secured at the holder, and/or the guide part or parts thereof are themselves flexible, for example in that the guide part comprises a leaf spring. The probe element is preferably adjustable in height. The probe element and the attachment of the guide part are arranged so as to be offset from one another with respect to the direction of travel of the cloth.

Furthermore, the invention comprises a weaving machine with at least one measuring apparatus in accordance with the invention. The at least one measuring apparatus of the invention is preferably displaceably arranged transversely to the direction of travel of the cloth. In a preferred embodiment the weaving machine has two warp beams, with the weaving machine being equipped with at least one measuring apparatus in accordance with the invention for each warp beam, and with the two measuring apparatuses individually being arranged so as to be displaceable transversely to the direction of travel of the cloth.

The measuring apparatus in accordance with the invention has the advantage that the measurement position can largely be freely chosen, since the measuring apparatus is executed as a module. The measuring apparatus in accordance with the invention can for example be arranged displaceably on a carrier section, through which a displaceability transverse to the direction of travel of the cloth can be achieved in a simple manner. As was initially mentioned, in double beam weaving machines it is particularly important for the measuring apparatus for the measurement of the cloth tension to be laterally displaceable when the cloth width is changed. In contrast to this, numerous measuring apparatuses for the measurement of the cloth tension are known from the prior art which are either integrated into the drive parts or cloth guiding parts of the weaving machine or use such parts as an integral component. In these solutions the measurement position is predetermined by the weaving machine parts used and can be changed only with a greater amount of effort.

A further advantageous property of the solution in accordance with the invention consists in that the probe element and the guide part can be manufactured with comparatively low mass, since they are independent of the drive parts and cloth guiding parts of the weaving machine. The measuring apparatus in accordance with the invention is thus suitable for high dynamic response, and the mass of the probe element and the guide part can be chosen such that the influence of oscillations of the weaving machine remains small.

A further advantage of the measuring apparatus in accordance with the invention is the one-sided attachment of the guide part to the holder. A guiding of the probe element which is free from play and is stable over long periods of time can thereby be achieved. If the probe element and the securing of the guide part are sufficiently offset from one another with respect to the direction of travel of the cloth, the frictional forces of the cloth which arise at the probe element have practically no influence on the measurement result. For the named reasons the measuring apparatus in accordance with the invention permits a precise measurement of the cloth tension which is stable over long periods of time.

The invention will be explained in the following in more detail with reference to exemplary embodiments and with reference to the drawings.

DETAILED DESCRIPTION OF THE DRAWINGS

Figure 2A:
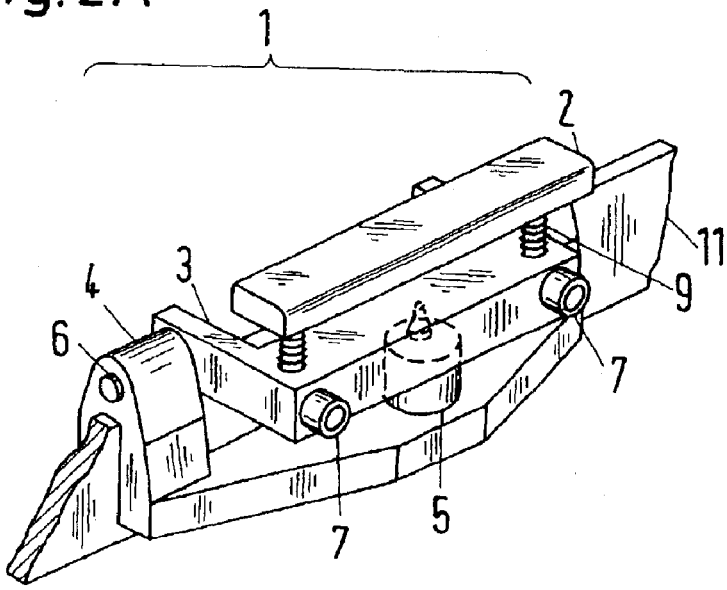
Figure 5:
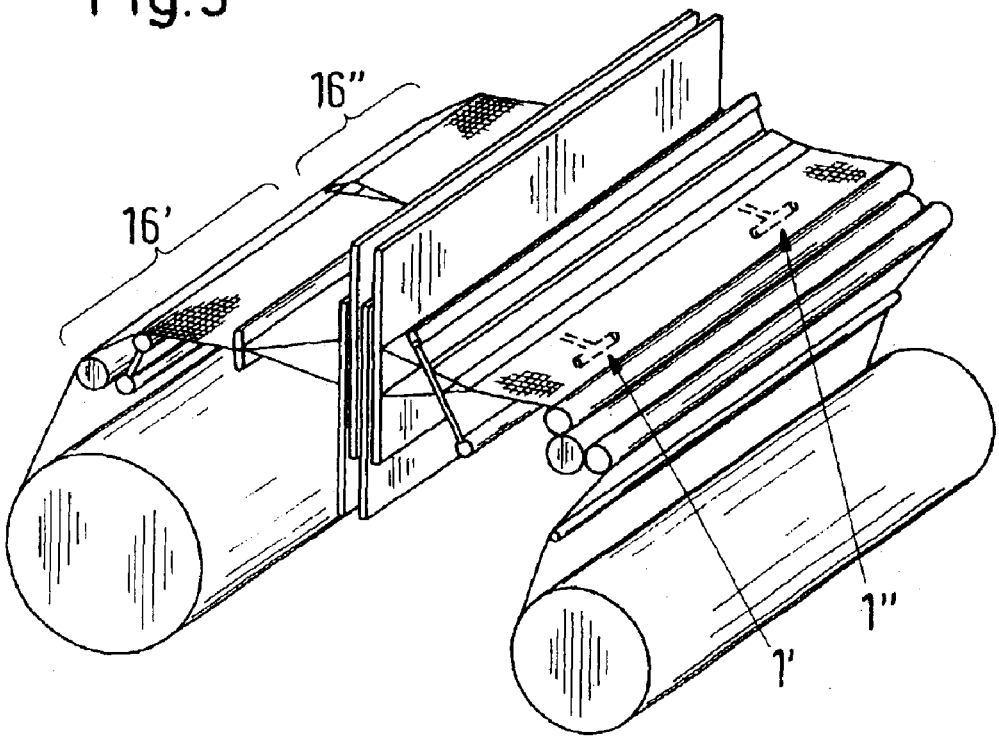
Figure 2B:
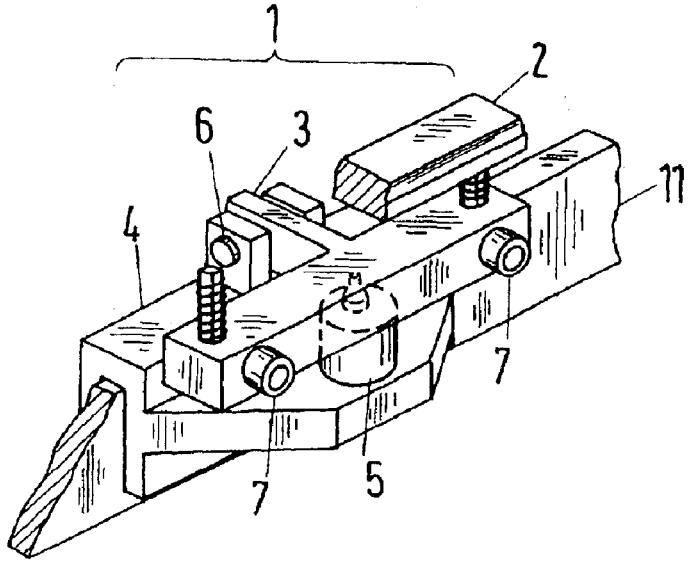
Figure 3:
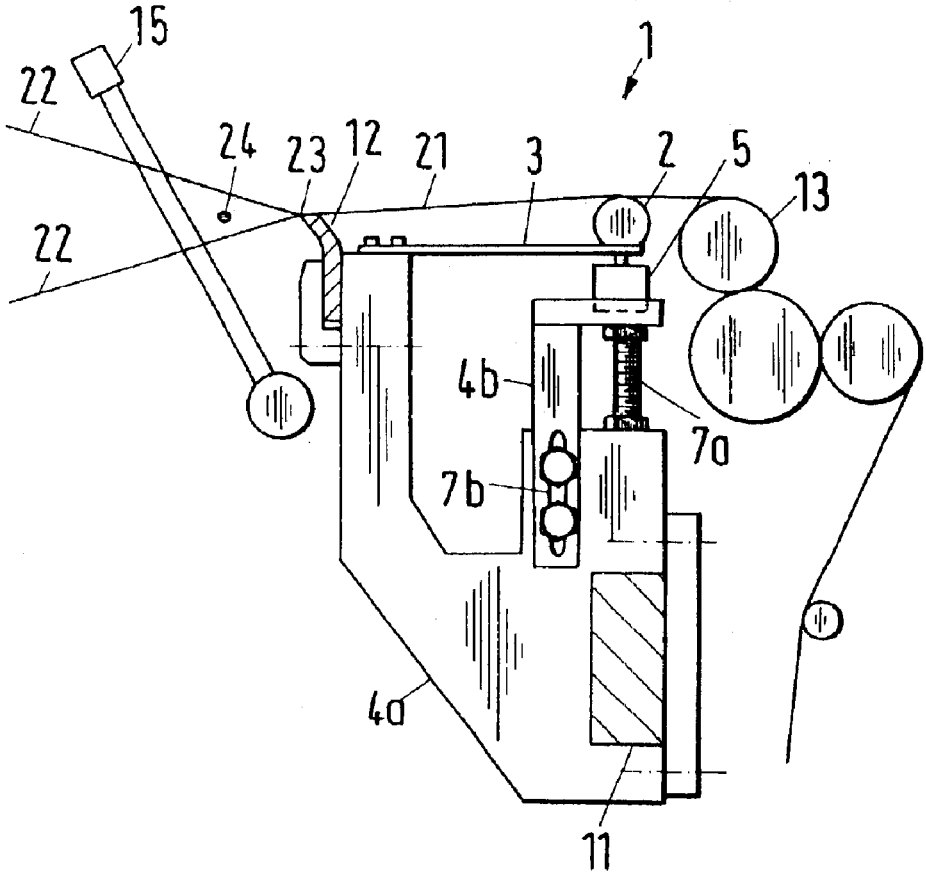
Figure 4:
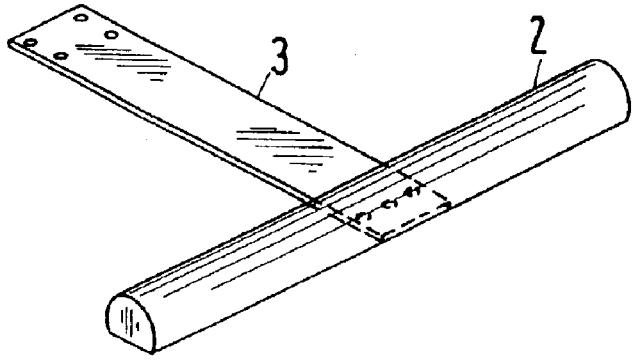

FIG. 1 is a side view of a first exemplary embodiment of the present invention in the installed state, FIG. 2*a* is a perspective view of a variant of the first exemplary embodiment of the present invention, FIG. 2*b* is a perspective view of a further variant of the first exemplary embodiment of the present invention, FIG. 3 is a side view of a second embodiment of the present invention in the installed state, FIG. 4 is a perspective view of the probe element and of the guide part in accordance with the second embodiment, and FIG. 5 is a schematic illustration of a double beam weaving machine with two measuring apparatuses for the measurement of the cloth tension.

DESCRIPTION OF THE PREFERRED EMBODIMENTS

FIG. 1 shows a side view of a first embodiment of a measuring apparatus for the measurement of the cloth tension in accordance with the present invention. The side view of FIG. 1 shows the measuring apparatus in the installed state. In this the cloth 21, which is formed at the beat-up line 23, i.e. at the cloth edge, is guided over a cloth support 12 and further over a probe element 2 of the measuring apparatus 1 to a deflection roller 13 and then to a cloth drive 14. A fixed breast beam section can also be provided in place of the deflection roller 13, the so-called breast beam, at the same position. The probe element 2 of the measuring apparatus 1 is arranged in such a manner that the cloth 21 is pressed upwards slightly by the probe element 2 in order to pick up a contact pressure which is produced by the cloth tension and a force vector resulting therefrom. FIG. 1 also illustrates a reed 15, weft yarns 22, and an inserted weft thread 24.

In the embodiment the probe element 2 of the measuring apparatus 1 is vertically adjustably secured to a guide part 3, which is attached to a holder 4 via at least one pivot bearing 6. FIG. 2*a* shows for example a variant with two lateral pivot bearings 6, with the second pivot bearing being hidden by the probe element 2 in the perspective view. As shown in FIG. 2*b*, only a single pivot bearing 6 can, for example, also be provided in the middle instead of two lateral pivot bearings. A hold-down spring 8 prevents upward rotation of the measuring apparatus 1 in the unused state. The pivot axis 6 is arranged transversely to the direction of travel of the cloth in the exemplary embodiment, and the probe element 2 is offset relative to the pivot bearing 6 in the direction of travel of the cloth. In this way a guidance of the probe element 2 in the direction of the force vector perpendicularly to the cloth surface to be probed can be achieved which is stable over long periods of time. A sensor element 5, for example a calibrated load cell with a measurement pickup pin, is arranged on the holder 4 in such a manner that the sensor element 5, i.e. in the example the measurement pickup pin, makes contact with the guide part 3; and the force vector which acts on the probe element 2 is transmitted via the guide part 3 to the sensor element 5, where the force vector causes a corresponding change, for example a change in the resistance or in the output current. The measurement path of the load cell which is used in the example amounts to 0.01 mm at the maximum and is thus negligible. In the embodiment the sensor element 5 is for example loosely inserted into a recess and can be replaced in a simple manner.

The measurement range of the measuring apparatus 1 which is described in the above exemplary embodiment can be adapted without great effort through setting of the deflection angle of the cloth, i.e. the height of the probe element 2, or through the use of different load cells with measurement ranges of for example 100, 300 or 600 N. The height of the probe element 2, of the order of magnitude of 1 to 10 mm above the zero position of the cloth, i.e. above the position which the tensioned cloth assumes without the measuring apparatus 1, can be set in a simple manner with a correspondingly calibrated gauge. For the setting of the height of the probe element 2, the measuring apparatus of the exemplary embodiment is equipped with an apparatus for height adjustment, which is shown in FIG. 2. The probe element 2 is provided with two pins, which are arranged at a spacing and which are displaceably arranged in bores of the guide part 3. Two compression springs 9 press the probe element 2 against the gauge without play. The set height is fixed by means of two setscrews 7. The height of the probe element 2 can be set precisely to within ±0.05 mm in the exemplary embodiment, which yields a measurement error of ±1% in the measured cloth tension at a height of the probe element 2 of 5 mm above the zero position of the cloth. In the event that this error is a problem, the measurement result can be corrected using software. Strictly speaking, the probe element 2 is guided along a circular path about the pivotal axis. Since the measurement displacement of at most 0.01 mm is small in comparison with the length of the lever arm which is formed by the guide part 3, the measurement errors which are caused by the one-sided attachment are negligible. The height of the probe element 2 above the pivot axis 6 is advantageously chosen to be significantly smaller than the length of the lever arm which is formed by the guide part 3. In this case the friction forces of the cloth which arise at the probe element have no influence on the measurement result worthy of mention.

The measuring apparatus 1 which is described in the above exemplary embodiment is a module which can be positioned at any desired free location along the path of the cloth for the measurement of the cloth tension. For the measurement, the measuring apparatus need only be secured at the desired location on the weaving machine and the probe element of the measuring apparatus brought into contact with the cloth.

In a preferred variant the measuring apparatus 1 is displaceably mountable on a carrier or on a carrier section 11. In a weaving machine with a measuring apparatus of this kind the carrier section 11 is advantageously arranged transversely to the direction of travel of the cloth and is firmly connected to the frame of the weaving machine. This variant is also particularly suitable for double beam weaving machines, in which the warp tensions of the two warp beams must be of equal magnitude. In a change of the cloth width, the position of the measuring apparatuses 1 in accordance with the exemplary embodiment can e.g. be adapted in such a manner that a measurement is made approximately in the middle of each of the right and the left cloth halves.

FIG. 3 shows a side view of a second embodiment of a measuring apparatus for the measurement of the cloth tension in accordance with the present invention. The side view of FIG. 3 shows the measuring apparatus 1 in the installed state. In the second embodiment the probe element 2 of the measuring apparatus 1, which can for example be executed as an elongate probe tube or as a probe strip, is secured on a flexible guide part 3, for example an elongate leaf spring. In the second embodiment the flexible guide part 3 is anchored at a holder 4*a* and the probe element 2 is arranged offset from the anchoring point of the guide part 3 in the direction of travel of the cloth. In this way a guiding of the probe element 2 in the direction of the force vector perpendicular to the cloth surface to be probed can be achieved which is free from play and stable over long periods of time and which has good stability both in the transverse direction and also with respect to the tractive or thrust force of the cloth. A possible torsion or twisting of the probe element 2 is desirable, since the cloth tension is thereby averaged over the extent of the probe element 2. A sensor element 5, for example a calibrated load cell with a measurement pickup pin, is secured at the holder 4*a* by means of a height adjustable sensor holder 4*b*. The sensor element 5, i.e. the measurement pickup pin in the example, is arranged in such a manner that it makes contact with the guide part 3; and the force vector which acts on the probe element 2 is transmitted via the guide part 3 to the sensor element 5, where the force vector causes a corresponding change, for example a change in the resistance or in the output current.

The height of the probe element 2 and thus the magnitude of the contact pressure which is exerted by the cloth tension can be set in the second embodiment in a simple manner with an appropriately calibrated gauge. The setting of the height of the probe element 2 takes place by means of a setting screw 7*a*which is arranged below the sensor element 5 between the sensor holder 4*b* and the holder 4*a*, and by a locking member 7*b*, which fixes the sensor holder 4*b* at the desired height at the holder 4*a*. The probe element 2 and the guide part 3 of the exemplary embodiment can be manufactured with comparatively low mass, since they are independent of the weaving machine parts which guide and transport the cloth. Thanks to the low mass of the probe element and the guide part a high dynamic response can be achieved with the measuring apparatus in accordance with the exemplary embodiment, and the mass of the probe element and the guide part can be chosen in such a manner that the influence of oscillations of the weaving machine remains small. The measuring apparatus 1 which is described in the second embodiment likewise forms a module with the advantages which were described in the context of the first embodiment.

FIG. 5 shows a schematic illustration of a weaving machine with two warp beams 16' and 16", with the weaving machine being equipped with at least one measuring apparatus for each warp beam, for example with at least one measuring apparatus in accordance with the above two embodiments, and with the respective measuring apparatuses 1', 1" being individually displaceably arranged transverse to the direction of travel of the cloth. In a preferred variant the measuring apparatuses 1' and 1" are displaceably secured on a carrier or on a carrier section, the carrier section advantageously being arranged transverse to the direction of travel of the cloth and firmly connected to the frame of the weaving machine. The measuring apparatuses 1' and 1" are advantageously arranged in such a manner that the distance from the middle of the cloth is the same on the right and the left and the measurement is carried out on each side approximately in the middle of the cloth halves. The measuring apparatuses 1' and 1" are advantageously arranged between the beat-up line, i.e. the cloth edge and the breast beam.

What is claimed is:

1. A measuring apparatus for measuring the cloth tension in a weaving machine, comprising a probe element in order to pick up the contact pressure exerted on a cloth and a force vector resulting therefrom, a guide part to which the probe element is connected in order to guide the probe element in the direction of the force vector, a holder to which the guide part is attached, and a sensor element which is in active contact with the probe element, so that the force vector which acts on the probe element causes a corresponding change in the sensor element, wherein the guide part is attached at one side to the holder, wherein the probe element is spaced from the attachment of the guide part, and wherein the measuring apparatus is executed as an independent constructional unit.

2. A measuring apparatus in accordance with claim 1, wherein the holder is displaceably mountable on a carrier or on a carrier section.

3. A measuring apparatus in accordance with claim 1, wherein the probe element is guided substantially perpendicularly to the cloth surface.

4. A measuring apparatus in accordance with claim 1, wherein the guide part is rotatably attached to the holder.

5. A measuring apparatus in accordance with claim 1, wherein the guide part or parts thereof are flexible and/or the guide part is flexibly attached to the holder.

6. A measuring apparatus in accordance with claim 5, wherein the guide part comprises a leaf spring.

7. A measuring apparatus in accordance with claim 1, wherein the probe element is adjustable in height.

8. A measuring apparatus in accordance with claim 1, wherein the probe element and the attachment of the guide part with respect to the direction of travel of the cloth are arranged mutually offset.

9. A weaving machine comprising at least one measuring apparatus for measuring the cloth tension, wherein the measuring apparatus comprises a probe element in order to pick up the contact pressure exerted on a cloth and a force vector resulting therefrom, a guide part to which the probe element is connected in order to guide the probe element in the direction of the force vector, a holder to which the guide part is attached, and a sensor element which is in active contact with the probe element, so that the force vector which acts on the probe element causes a corresponding change in the sensor element, wherein the guide part is attached at one side to the holder, wherein the probe element is spaced from the attachment of the guide part, and wherein the measuring apparatus is executed as an independent constructional unit.

10. A weaving machine in accordance with claim 9, wherein the at least one measuring apparatus is arranged so as to be displaceable transversely to a direction of travel of the cloth.

11. A weaving machine in accordance with claim 9, further comprising two warp beams, wherein the weaving machine is equipped with at least one measuring apparatus for each warp beam, and wherein the respective measuring apparatuses are individually arranged so as to be displaceable transversely to a direction of travel of the cloth.

12. A weaving machine comprising two warp beams, wherein the weaving machine is equipped with at least one measuring apparatus for the measurement of cloth tension for each warp beam, wherein the respective measuring apparatuses for the measurement of the cloth tension are executed as separate modules.

13. A weaving machine in accordance with claim 12, wherein the respective measuring apparatuses for the measurement of the cloth tension are individually arranged so as to be displaceable transversely to a direction of travel of the cloth.

14. A weaving machine in accordance with claim 12, wherein the respective measuring apparatuses for the measurement of the cloth tension are individually displaceably arranged on a carrier or on a carrier section.

15. A weaving machine in accordance with claim 12, wherein the respective measuring apparatuses for the measurement of the cloth tension are arranged between the cloth edge and the breast beam.

* * * * *